US012422205B1

(12) United States Patent
Kroyer

(10) Patent No.: US 12,422,205 B1
(45) Date of Patent: Sep. 23, 2025

(54) FIREARM MAGAZINE

(71) Applicant: Josef Kroyer, Zemendorf (AT)

(72) Inventor: Josef Kroyer, Zemendorf (AT)

( * ) Notice: Subject to any disclaimer, the term of this patent is extended or adjusted under 35 U.S.C. 154(b) by 14 days.

(21) Appl. No.: 18/610,380

(22) Filed: Mar. 20, 2024

(51) Int. Cl.
*F41A 9/65* (2006.01)

(52) U.S. Cl.
CPC ..... *F41A 9/65* (2013.01)

(58) Field of Classification Search
CPC ..... F41A 9/65
See application file for complete search history.

(56) References Cited

U.S. PATENT DOCUMENTS 304,712 A * 9/1884 Diss ..... F41A 9/65 42/50
506,323 A * 10/1893 Lee ..... F41A 9/65 42/50
1,323,063 A * 11/1919 Johnson et al. ..... F41A 9/65 42/50
1,331,155 A * 2/1920 Johnson ..... F41A 9/65 42/50
1,348,172 A * 8/1920 Hammond ..... F41A 9/65 42/50
1,352,413 A * 9/1920 Payne ..... F41A 3/82 89/185
1,462,972 A * 7/1923 Lewis ..... F41A 9/69 42/50
2,434,269 A * 1/1948 Harvey ..... F41A 9/69 42/50
4,589,218 A * 5/1986 Teppa ..... F41A 9/69 42/50
4,614,052 A * 9/1986 Brown ..... F41A 9/65 42/87
5,666,752 A * 9/1997 Grams ..... F41A 9/71 42/49.02
5,956,878 A * 9/1999 Yang ..... F41A 9/65 42/6
7,093,386 B1 * 8/2006 Vieweg ..... F41A 9/65 42/7
8,028,455 B1 * 10/2011 Battaglia ..... F41A 9/71 42/49.02
8,850,732 B2 * 10/2014 Zheng ..... F41A 9/70 42/49.02
10,577,197 B1 * 3/2020 Burnsed, Jr. ..... B65G 59/02
12,146,721 B2 * 11/2024 Williams ..... F41A 9/65
12,203,719 B1 * 1/2025 Hart ..... F41A 9/70
2010/0101132 A1 * 4/2010 Jacobson ..... F41A 9/65 42/50
2012/0233899 A1 * 9/2012 Daniel ..... F41A 9/65 42/49.01
2013/0086834 A1 * 4/2013 Battaglia ..... F41A 9/65 42/49.02

(Continued)

*Primary Examiner* — Derrick R Morgan
(74) *Attorney, Agent, or Firm* — Chrisman Gallo Tochtrop LLC

(57) ABSTRACT

A firearm magazine includes a tubular body defining a hollow interior and having a forward wall, a rearward wall, a first side wall, a second opposite side wall, an open top and an open bottom opposite the open top. The forward wall includes a joint at which a material of the tubular body is joined together, wherein the joint runs along the forward wall between the open top and the open bottom. A clamp is slid onto the tubular body and compresses at least a section of the forward wall, which section comprises the joint, in a side-to-side direction.

17 Claims, 10 Drawing Sheets

(56) References Cited

U.S. PATENT DOCUMENTS

| | | | | |
|---|---|---|---|---|
| 2015/0101228 | A1* | 4/2015 | Giannini | F41A 9/64<br>42/49.02 |
| 2017/0146308 | A1* | 5/2017 | Plumb | F41A 9/65 |
| 2017/0160038 | A1* | 6/2017 | Keng | F41A 23/04 |
| 2019/0049209 | A1* | 2/2019 | Grix | F41A 35/00 |
| 2019/0154390 | A1* | 5/2019 | DiLeo | F41A 35/02 |
| 2020/0056852 | A1* | 2/2020 | Thomele | F41A 9/70 |
| 2020/0400398 | A1* | 12/2020 | Dulude | F41A 17/46 |
| 2023/0243610 | A1* | 8/2023 | Thomele | F41A 9/65<br>42/50 |
| 2023/0304757 | A1* | 9/2023 | Bubits | F41A 9/41 |
| 2023/0349654 | A1* | 11/2023 | Zeider | F41A 9/69 |
| 2023/0366664 | A1* | 11/2023 | Darby | F42B 39/02 |

* cited by examiner

FIREARM MAGAZINE

BACKGROUND OF THE INVENTION

The present invention relates to the field of firearm magazines.

Magazines are critical components in semi-automatic and automatic pistols, serving as the storage and feeding devices for ammunition. The design and functionality of a magazine significantly affect the reliability and performance of a firearm.

The body of the magazine is engineered to store a stack of cartridges in a compact, efficient manner. It is usually formed from high-strength materials such as steel or advanced polymers, chosen for their durability, resistance to wear, and ability to withstand the environmental pressures experienced during use. The body of the magazine is typically constructed using precision fabrication techniques such as stamping, molding, or machining, which ensure tight tolerances and smooth surfaces for reliable ammunition feeding. Magazine bodies may e.g. be formed by bending a flat (metal) sheet into a tubular shape to create the magazine body, which inherently results in a longitudinal joint or seam.

Thus, as a result of the manufacturing techniques, the tubular body of the magazine usually comprises a joint or seam at which a material of the body is joint together. E.g., the body may be formed by stamping or roll forming resulting in a longitudinal seam where the opposite ends of the reshaped plate meet. Traditionally, the joint is welded to connect the opposing ends. However, this prevents or limits the possibility for hardening or tempering the material, since this could result in stress cracks at the weld joint or its edges. These treatments would usually improve the material's hardness and toughness, making the magazine more resistant to physical shocks, abrasion, and corrosion. Further, the seam is a potential weak point.

US 2023/0349654 A1 shows a magazine with a metallic body having an increased capacity over a polymer magazine. According to this document, if a steel magazine is used in a Glock® handgun, the Glock® OEM polymer magazine catch can wear down over time creating reliability issues. This is because the steel of the magazine is much harder than the polymer of the magazine catch. A polymer can be placed over an upper edge of a magazine catch cut-out so as to cover the upper edge with polymer material to mitigate the wear of the steal magazine on the polymer magazine catch. The polymer can be formed as a polymer clip. Side portion of the clip include three vertically spaced fingers which fit into a forward portion of the cut-outs. Each middle finger includes a lip or flange that snaps around the forward vertical edge of its respective cut-out to retain the clip in place. However, as can be seen e.g. from FIG. 23 of said document, the clip does not act to compress a part of the forward wall of the body in the left-to-right (side-to-side) direction and snapping merely refers to the clip encompassing the ridge in the forward-to-aft direction with the lip of the middle finger. Further, it is unclear, where the body may comprise a seam and thus the clip cannot hold the body together at the seam.

It is an object of the present invention to remedy or alleviate at least one of the disadvantages of the prior art. In particular, it is an object of the present invention to provide a magazine with an increased resistance or durability or which can be hardened and tempered without risking stress cracks.

BRIEF SUMMARY OF THE INVENTION

This problem is solved by a firearm magazine comprising:

- a tubular body defining a hollow interior and having a forward wall, a rearward wall, a first side wall, a second opposite side wall, an open top (in particular with feed lips) and an open bottom, wherein the forward wall comprises a joint at which a material of the tubular body is joined together, wherein the joint runs along the forward wall between the open top and the open bottom; and
- a clamp, which is slid onto the tubular body and compresses at least a section of the forward wall, which section comprises the joint, in a side-to-side direction.

Since the clamp compresses the section in a side-to-side direction, the body is held together at the joint by the clamp. It is not necessary to weld the material at the joint, and thus there are no restrictions to the hardening or tempering of the body. Thus, the resistance and durability of the magazine are increased. Alternatively, if welding is performed, the joint is additionally strengthened. As an additional effect, the clamp may act as a support or spacer for the magazine in a magazine catch. Thus, it can reduce the wear of the magazine catch caused by the magazine and its material, in particular where the magazine is made from a harder material than the magazine catch.

In particular, the forward wall is arranged opposite the rearward wall. The first side wall and the second side wall extend from opposite edges of the forward wall and the rearward wall, respectively. Since the clamp compresses a section of the forward wall, the clamp is elastically stretched upon being slid onto the tubular body. In particular, the clamp presses together the forward wall in a side-to-side direction, e.g. by pressing together on the edges of the forward wall (the edges of the forward wall with the first side wall and the second side wall, respectively) and/or by pressing together the first side wall and the second side wall. Optionally, the clamp may only compress a section of the forward wall by engaging with the forward wall at two areas on opposite sides of the joint, e.g. by meshing or interlocking with the forward wall at the two areas. The side-to-side direction refers to a direction pointing from the first side wall to the second side wall (or the other way around), in particular orthogonal to a top-to-bottom direction and/or to a forward-to-rearward direction of the tubular body. In particular, the clamp is slid onto the tubular body in a forward-to-rearward direction (i.e. in the direction pointing from the forward wall to the rearward wall). The hollow interior is in particular configured to store ammunition cartridges.

Optionally, at least one of the first and second side walls have an edge configured to interact with a magazine catch, e.g. of a polymer frame pistol. In particular, the magazine catch is configured to accommodate a single stack polymer or polymer-over-metal magazine or a double stack magazine. Optionally, the hollow interior is configured for storing cartridges. Optionally, a first internal dimension between the forward wall and the rearward wall is dimensioned to fit 9 mm Luger cartridges (e.g. according to the SAAMI Standard, the CIP Standard or the Austrian Standard). Optionally, a second internal dimension between the first side wall and the second opposite side wall is dimensioned to fit 9 mm Luger cartridges with a staggered arrangement of the cartridges. Optionally, a first external dimension of the body from the forward-most surface of the forward wall and the clamp to the rearmost surface of the rearward wall matches the corresponding exterior dimension of the single stack polymer or polymer-over-metal magazine is configured to fit into the magazine well, e.g. matches the corresponding exterior dimension of the single stack polymer or polymer-over-metal magazine or double stack magazine. Optionally, stored cartridges point towards the forward wall.

Optionally, the tubular body is substantially rectangular in cross-section. Optionally, a row of ammunition cartridges is aligned within the body. Optionally, there is provided for a follower for pushing the cartridges in the direction of the open top of the body. Optionally, the follower is biased by a compression spring. Optionally, the spring is retained by a removable closure member, in particular a floor plate, which is discussed in more detail below. The removable closure member provides an end against which the spring bears. At the open top of the body, known as the mouth, an ammunition cartridge may be presented and held in position by the feed lips. As the slide or bolt face cycles forward, this presented cartridge is stripped from the feed lips and guided into the chamber of the barrel. The follower in a single stack magazine may have a flat top surface that bears against an ammunition cartridge and will be retained by the feed lips when the cartridges have been depleted. A double stack magazine follower may be laterally asymmetrical to induce the staggered position of rounds as they are loaded into the magazine. A single round will be centered by the feed lips, even though the force applied by the follower may be off-center because of its laterally asymmetric shape. Optionally, the firearm magazine is for a Glock® handgun, e.g. a Glock® 43X hand gun.

Optionally, the joint is a juncture or a seam. In particular, at the joint, two edges of the material meet. The joint may extend the forward wall (in particular in an axial direction of the body) meandering. Optionally, the joint extends along the forward wall between the open top and the open bottom, in particular from the open top to the open bottom.

Optionally, the clamp is in contact with (i.e. abuts) a section of the first side wall and a section of the second side wall. The section is preferably adjacent to the forward wall.

Optionally, the clamp comprises:

- a first clamp side wall, in particular in contact with a section of the first side wall of the tubular body;
- opposite the first clamp side wall a second clamp side wall, in particular in contact with the second side wall of the tubular body; and
- a clamp forward wall connecting the first clamp side wall and the second clamp side wall and optionally in contact with the forward wall of the tubular body. Thus, the clamp may have a U-profile (in a cross-section orthogonal to the top-to-bottom direction). Thus, the clamp wraps around a section of the first side wall, a section of the front wall and a section of the second side wall.

Optionally, the clamp is elastically stretched in a side-to-side direction by the tubular body, in particular by the first side wall and the second side wall as it is slid onto the tubular body.

Optionally, the clamp extends in an axial direction of the tubular body over at least half of the dimension of the forward wall. Thus, the joint can be resiliently clamped together. Optionally, the clamp extends in the axial direction of the tubular body over at least 30%, preferably at least 40%, more preferably at least 55%, of the (axial) dimension of the forward wall. The axial direction of the tubular body corresponds to the top-to-bottom direction of the tubular body. Optionally, the clamp compresses the forward wall at least in a central portion of the forward wall in the top-to-bottom direction of the body. Optionally, the clamp encompasses at least the central 30% of the forward wall in the top-to-bottom direction of the body.

Optionally, the first side wall and the second side wall each comprise at least one interacting latching element and the clamp comprises corresponding interacting latching elements, wherein each of the at least one interacting latching element of the first side wall and of the second side wall engages with one of the interacting latching elements of the clamp. Optionally, the interacting latching elements snap in as the clamp is slid onto the body so as to hold the clamp on the body.

Optionally, the at least one interacting latching element of the first side wall and of the second side wall each comprises a recess and each of the interacting latching elements of the clamp comprises a protrusion received in the corresponding recess of the at least one interacting latching element of the first side wall and of the second side wall, respectively. Alternatively, each of the interacting latching elements of the clamp comprises a recess and the at least one interacting latching element of the first side wall and of the second side wall each comprises a protrusion receiving in the corresponding recess of the interacting latching elements of the clamp.

Optionally, the tubular body comprises (in particular consists of) a metal, e.g. steel or aluminum. In this way, its walls can be thinner than for a polymer body, thus providing more space for cartridges.

Optionally, the clamp comprises (in particular consists of) a metal. This allows a particularly durable holding together of the joint.

Optionally, the tubular body is formed of at least one sheet material, wherein two edges of the at least one sheet material contacting each other form the joint. E.g., the sheet material is bend, e.g. by stamping or roll forming, in the form of the tubular body, with its two edges joining and contacting each other at the joint. Optionally, if the tubular body is formed of more than sheet material, the tubular body may comprise more than one joint.

Optionally, the rearward wall comprises an inwardly (i.e. in the direction of the forward wall) projecting protrusion extending in the axial direction of the tubular body (over at least a section of the rearward wall). This allows to adjust the position of the cartridges in the body, which may be necessary if the body is made of metal instead of an OEM polymer magazine with a thicker polymer body. Optionally, the protrusion extends in the axial direction of the tubular body. Optionally, the protrusion extends over at least 80% of the top-to-bottom dimension of the rearward wall, preferably from the open bottom to the open top. Optionally, the protrusion has the form of a longitudinal rib or ridge. The protrusion can be stamped or roll formed into the sheet material as it is formed into the shape of the body.

Optionally, the inwardly projecting protrusion is integrally formed as a part of the rearward wall of the tubular body.

Optionally, the firearm magazine further comprises a removable closure member enclosing the open bottom of the body, comprising a base element and at least two side elements extending from the base element in the direction of the open top of the tubular body to contact opposite ones of the forward wall, the rearward wall, the first side wall and the second side wall of the tubular body,

- wherein each of the two side elements comprises an aperture and each of the opposite ones of the forward wall, the rearward wall, the first side wall and the second side wall of the tubular body each comprise a corresponding aperture, wherein a locking element is slid into the aperture of each of the two side elements and the corresponding aperture of each of the opposite ones of the forward wall, the rearward wall, the first side wall and the second side wall of the tubular body to secure the removable closure member to the tubular body. I.e., the locking element is provided in the apertures. This eliminates the need for side tabs adjacent to the open bottom of the tubular body, onto which the removable closure member is traditionally pushed. Thus, a bending tool for forming the body can be simpler and be manufactured more economical, while at the same time a secure connection is achieved in the event of a drop or throw. The opposite ones of the forward wall, the rearward wall, the first side wall and the second side wall of the tubular body are either the forward wall and the rearward wall; or the first side wall and the second side wall. Each of the elements/walls may comprise more than one aperture. Respectively one aperture of each of the two side elements and of each of the opposite ones of the forward wall, the rearward wall, the first side wall and the second side wall of the tubular body are aligned congruent to form a passage (pass-through), wherein one locking element is provided for in each passage. Preferably, one aperture of a first one of the two side elements, of the first side wall, of the second side wall and of a second one of the two side elements are aligned congruent to form the (respective) passage. A spring may be compressed within the body between the removable closure member and the follower. The spring-biased follower may push the row(s) of cartridges toward the open top and feed lips as cartridges are removed manually, or by cycling of the firearm's bolt/slide. The two side elements are arranged opposite each other. Optionally, there may be two further side elements provided, such that the two side elements and the two further side elements form substantially a lateral surface of a prism and the base element forms the base of the prism. Optionally, the side elements encompass a lower section (adjacent to the open bottom) of the tubular body. Optionally, the base element is a base plate.

Optionally, the locking element on the one hand and the removable closure member or the tubular body on the other hand comprise interacting snapping elements that prevent a sliding movement of the locking element in a secured state. Optionally, the interacting snapping elements prevent a sliding movement in a side-to-side or forward-to-rearward direction (and the other way around, respectively).

Optionally, the locking element comprises a recess (as interacting snapping element) into which an edge of one of the apertures is received (i.e. snaps in as the locking element is slid into the respective apertures). Optionally, the recess is an indentation in the bottom-to-top direction (i.e. the opening of the recess points away from the top).

Optionally, a part of one of the forward wall, the rearward wall, the first side wall and the second side wall of the tubular body is received in the recess of the locking element.

Optionally, the locking element is plate shaped and extends in a plane orthogonal to the top-to-bottom direction of the tubular body.

Optionally, the locking element is slid into the apertures in the side-to-side direction of the tubular body.

Optionally, the body and the clamp comprise at least one corresponding aperture for fixing the magazine in the magazine catch. In particular, the magazine catch may engage with the at least one corresponding aperture of the body and of the clamp to secure the magazine.

DETAILED DESCRIPTION OF THE INVENTION

Figure 1:
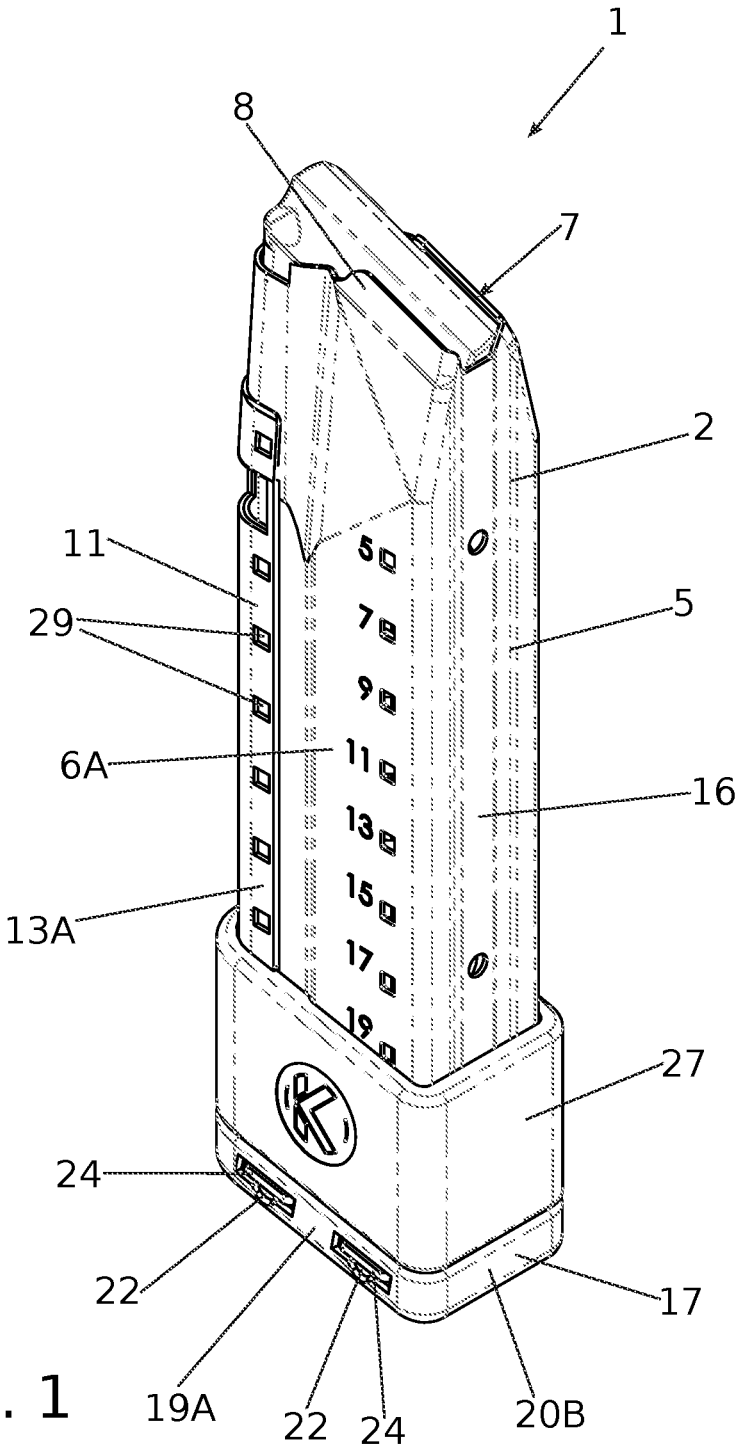
FIG. 1 schematically shows a preferred embodiment of a firearm magazine in an oblique view.
Figure 2:
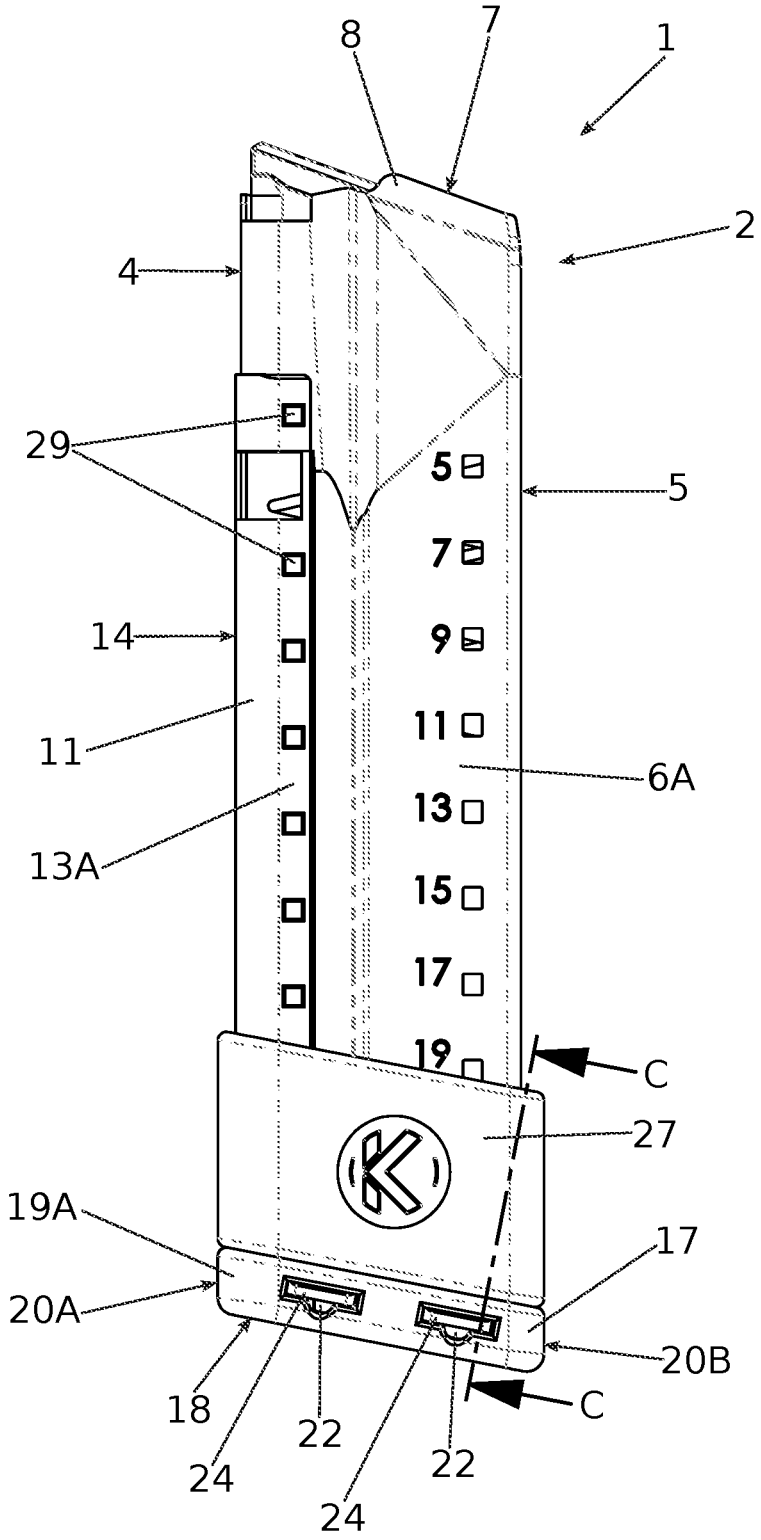
FIG. 2 schematically shows the same embodiment of the firearm magazine as FIG. 1 in a side view.
Figure 3:
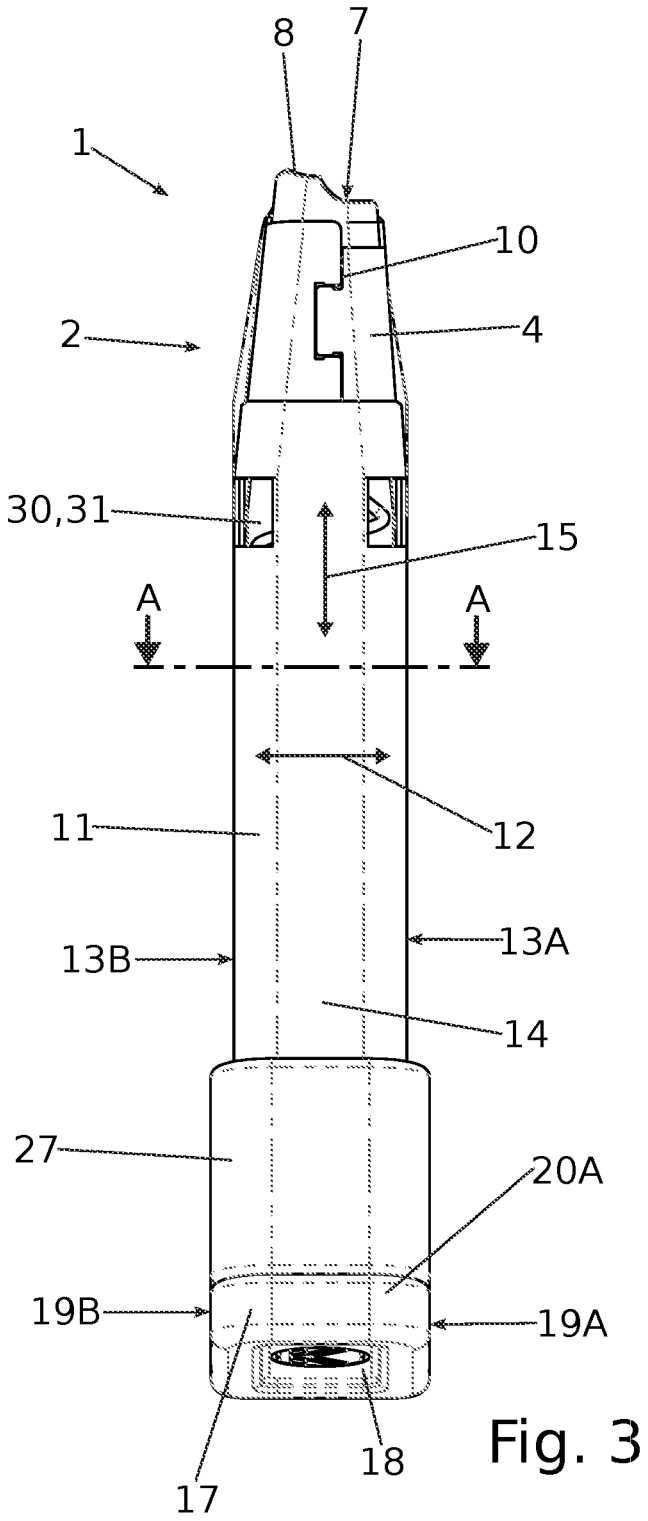
FIG. 3 schematically shows the same embodiment of the firearm magazine as FIG. 1 in a front view.
Figure 4:
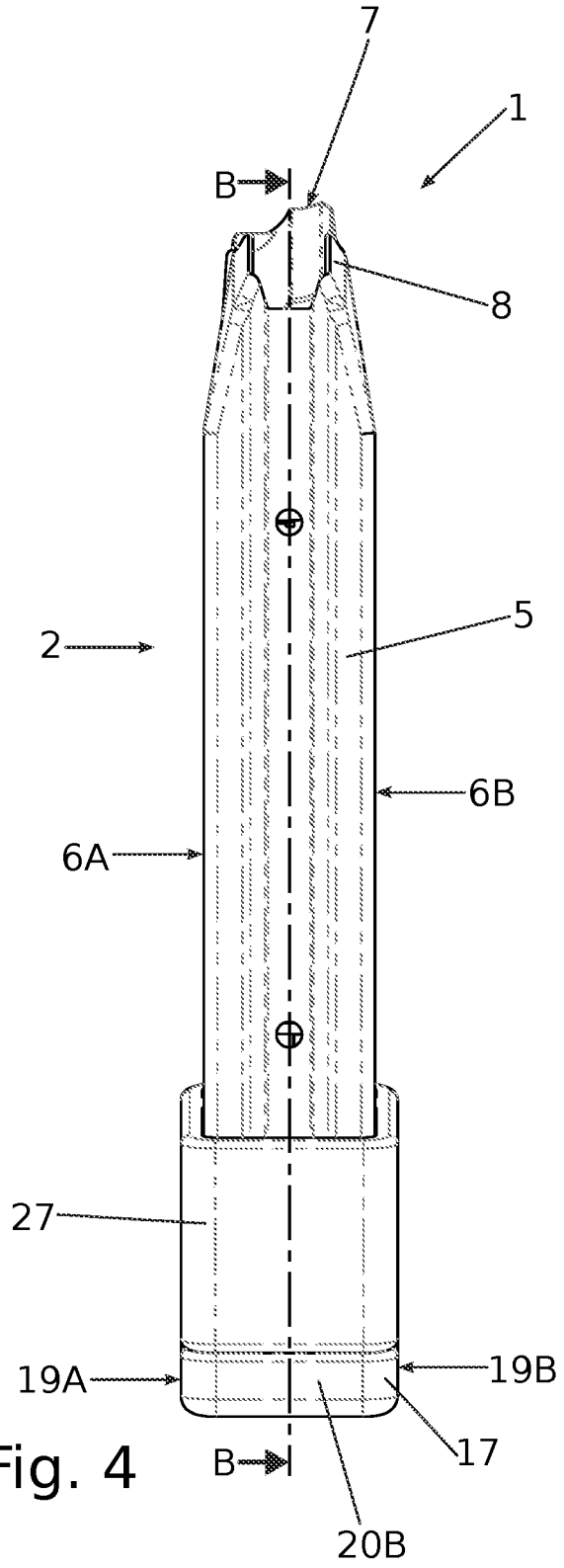
FIG. 4 schematically shows the same embodiment of the firearm magazine as FIG. 1 in a rear view.
Figure 5:
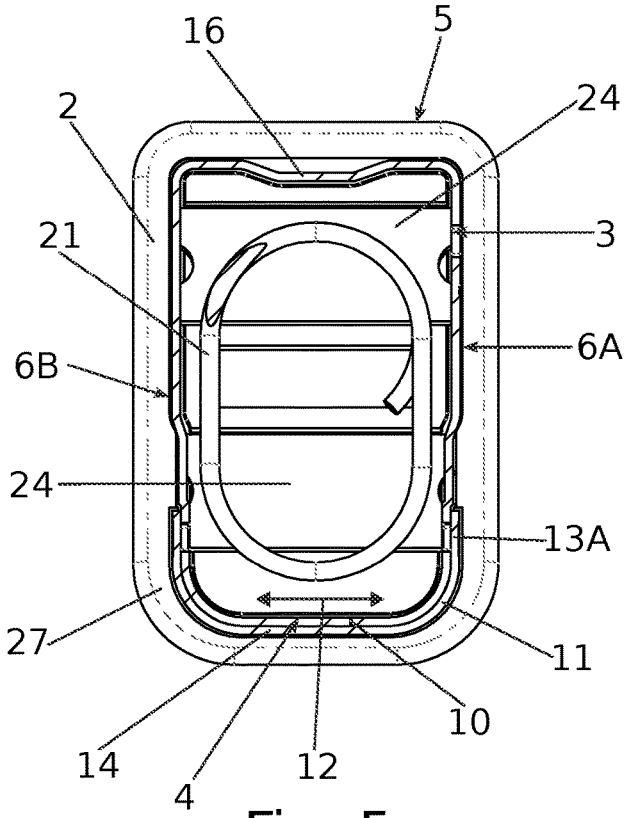
FIG. 5 schematically shows the same embodiment of the firearm magazine as FIG. 1 in a sectional view along the section A-A indicated in FIG. 1.
Figure 6:
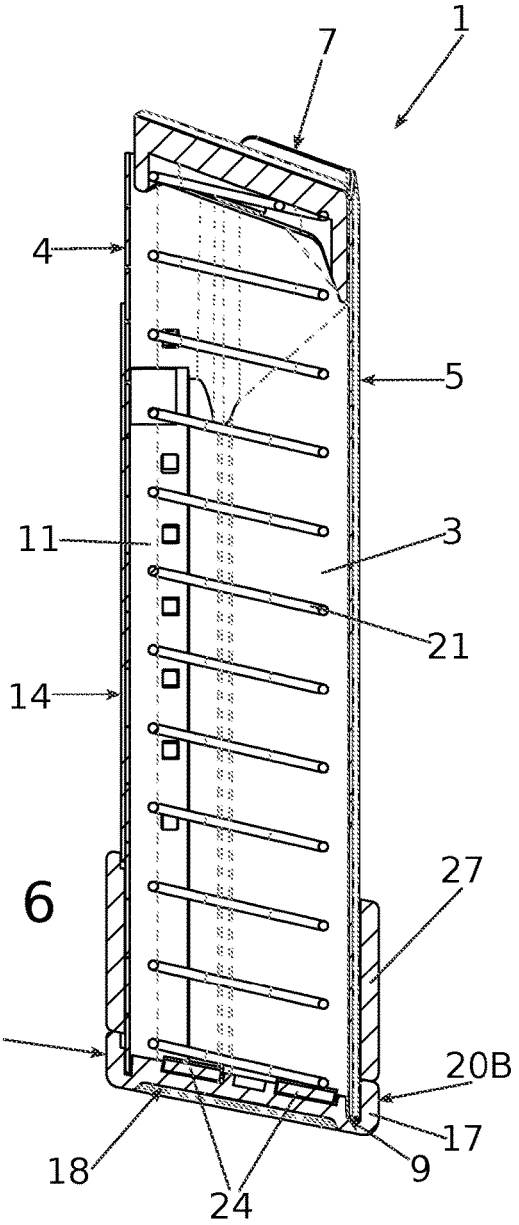
FIG. 6 schematically shows the same embodiment of the firearm magazine as FIG. 1 in a sectional view along the section B-B indicated in FIG. 4.
Figure 8:
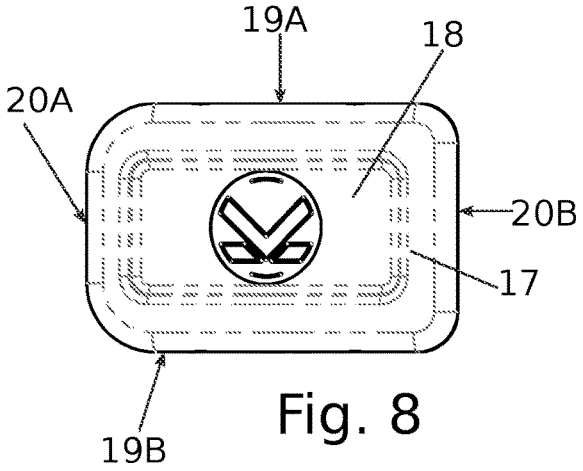
FIG. 8 schematically shows the same embodiment of the firearm magazine as FIG. 1 in a bottom view.
Figure 9:
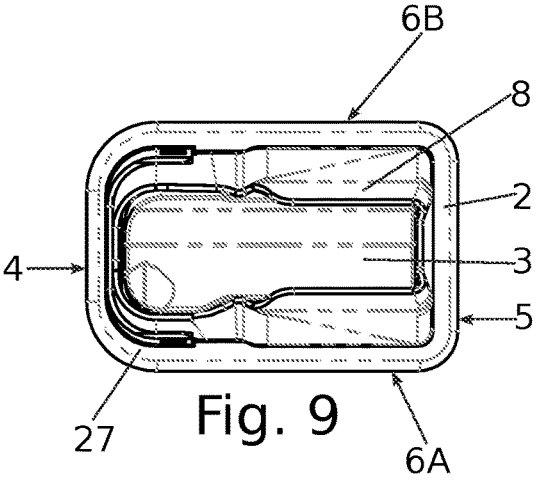
FIG. 9 schematically shows the same embodiment of the firearm magazine as FIG. 1 in a top view.

FIG. 1 schematically shows a preferred embodiment of a firearm magazine 1 in an oblique view. FIG. 2 schematically shows a side view of the same embodiment of the firearm magazine 1 as FIG. 1, FIG. 3 a front view, FIG. 4 a rear view, FIG. 5 a sectional view along the section A-A indicated in FIG. 1, FIG. 6 a sectional view along the section B-B indicated in FIG. 4, FIG. 7 a sectional view along the section C-C indicated in FIG. 2, FIG. 8 a bottom view and FIG. 9 a top view.

Figure 10:
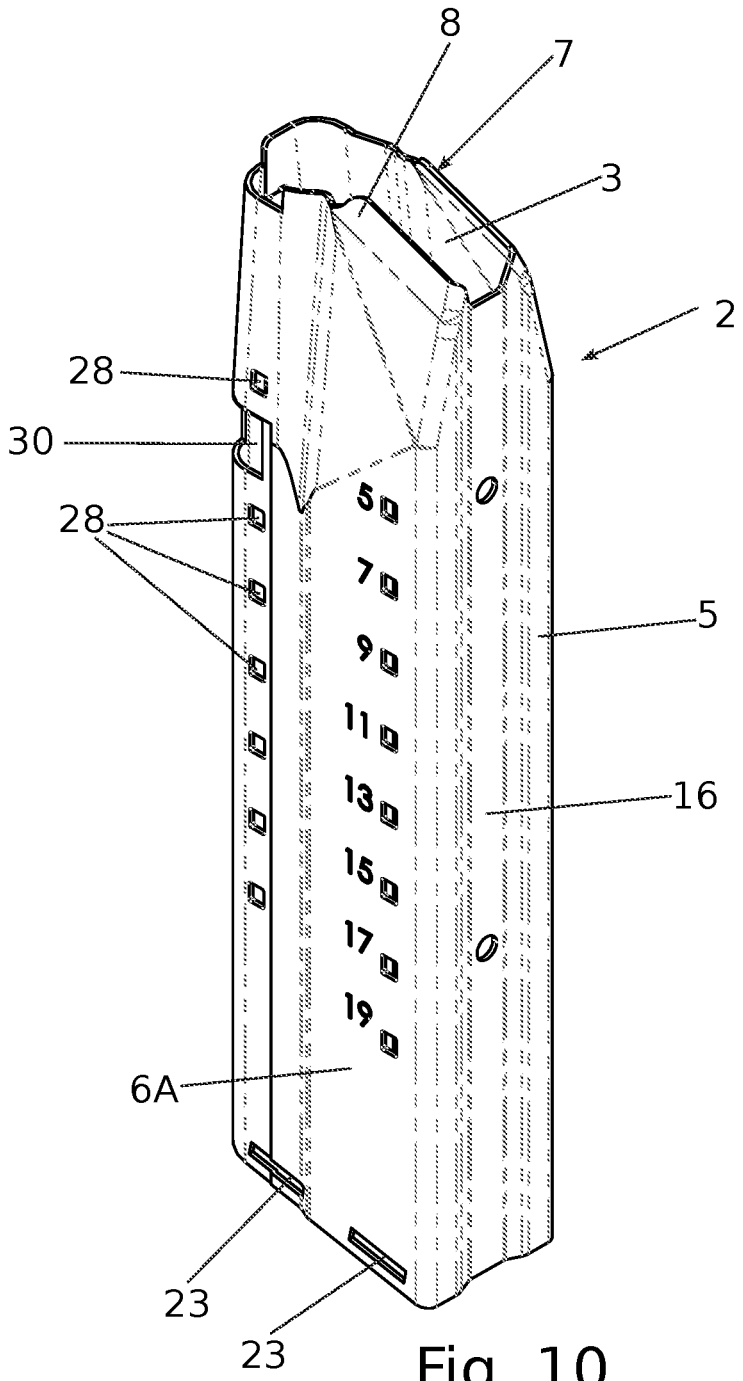
FIG. 10 schematically shows a body of the same embodiment of the firearm magazine as FIG. 1 in an oblique view.
Figure 11:
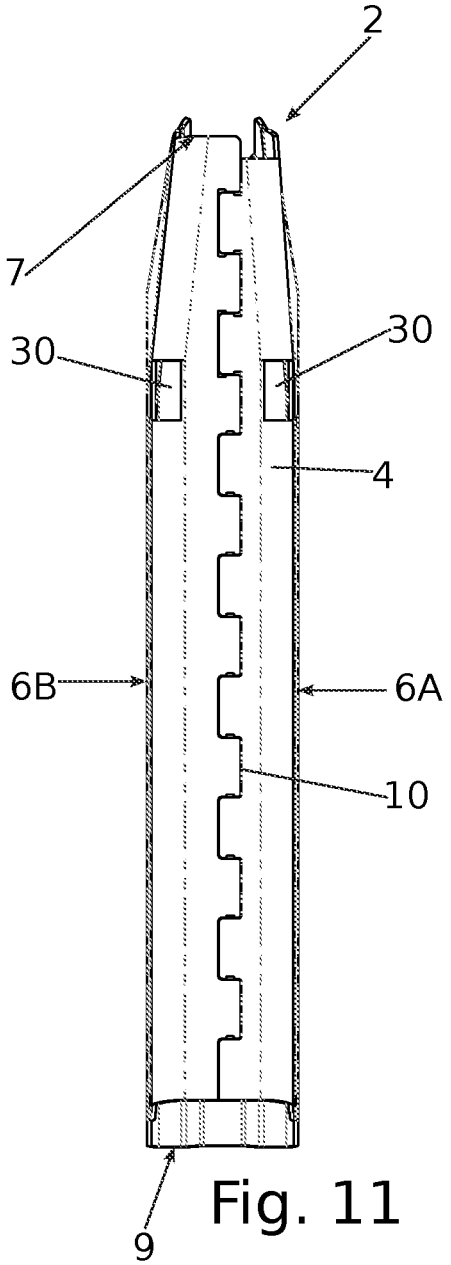
FIG. 11 schematically shows the body of the same embodiment of the firearm magazine as FIG. 1 in a front view.

The firearm magazine 1 comprises a tubular body 2 defining a hollow interior 3. FIG. 10 shows only the body 2 in an oblique view, FIG. 11 shows the body 2 in a front view. The tubular body 2 comprises a forward wall 4 (see e.g. FIG. 3), a rearward wall 5 opposite the forward wall 4, a first side wall 6A, a second opposite side wall 6B, an open top 7 with feed lips 8 and an open bottom 9 opposite the open top 7, wherein the forward wall 4 comprises a joint 10 (see FIG. 3 and FIG. 5) at which a material of the tubular body 2 is joined together, wherein the joint 10 runs (meandering, as can be seen in FIG. 11) along the forward wall 4 between the open top 7 and the open bottom 9. In particular, the body 2 is formed of a sheet material, wherein two edges of the sheet material meet at the joint 10. The tubular body 2 is substantially rectangular in shape.

Figure 12:
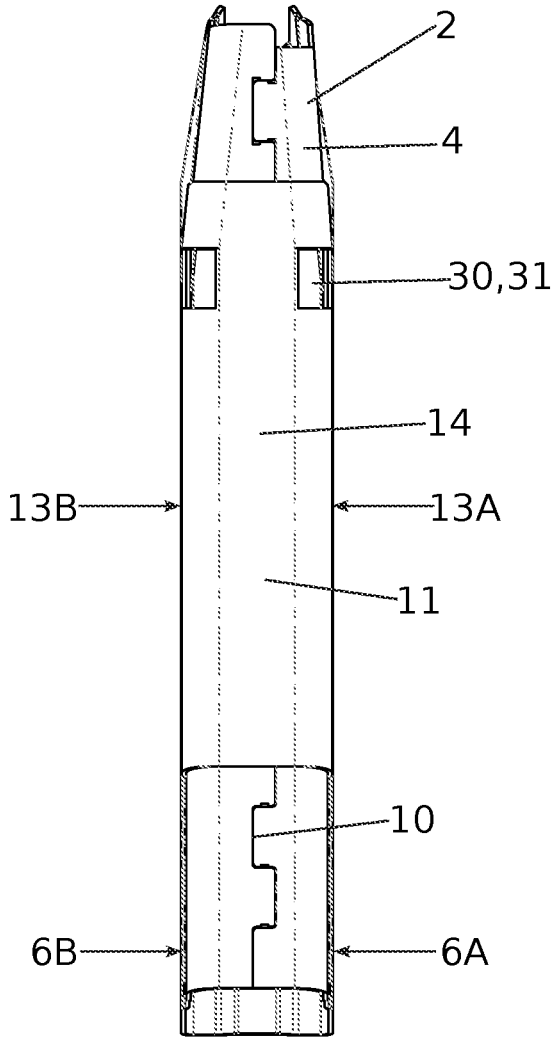
FIG. 12 schematically shows the body and a clamp pushed on the body of the same embodiment of the firearm magazine as FIG. 1 in a front view.
Figure 13:
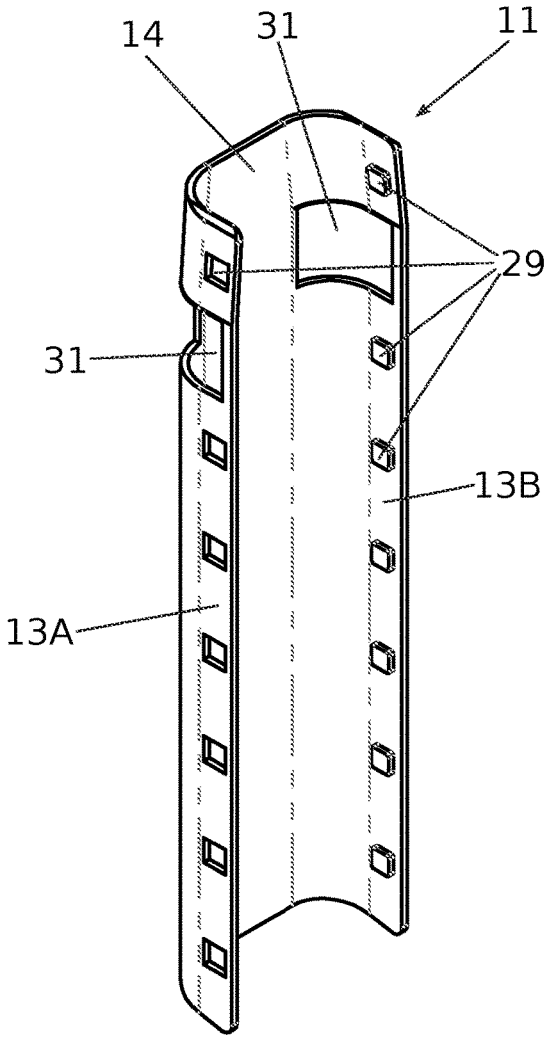
FIG. 13 schematically shows the clamp of the same embodiment of the firearm magazine as FIG. 1 in an oblique view.
Figure 14:
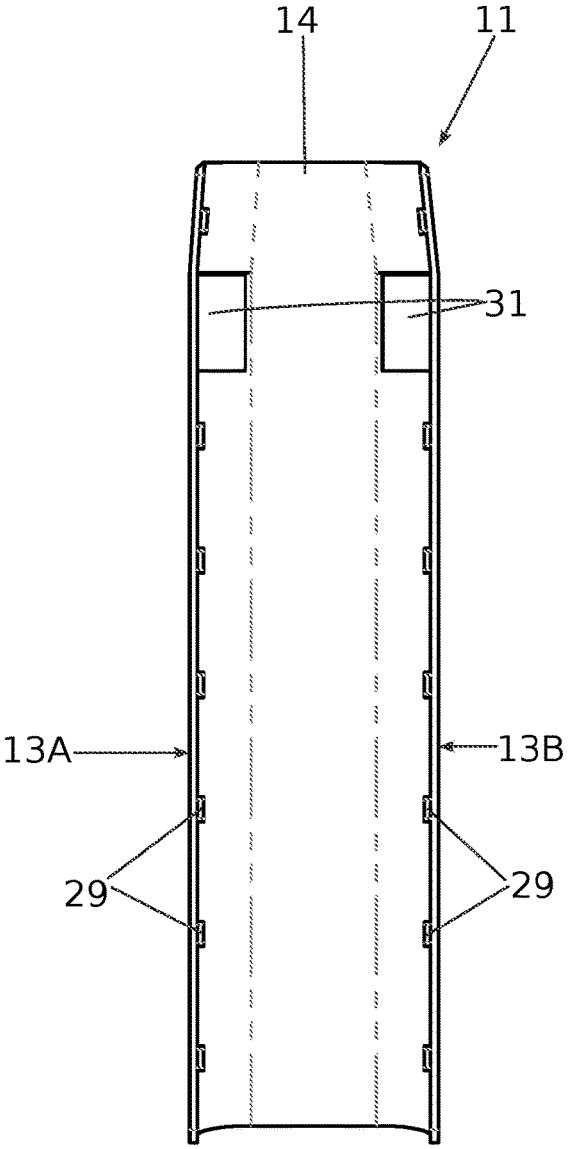
FIG. 14 schematically shows the clamp of the same embodiment of the firearm magazine as FIG. 1 in a rearwards view.

Further, the firearm magazine 1 comprises a clamp 11, which is slid onto the tubular body 2, in particular onto the forward wall 4 and the adjacent sections of the first side wall 6A and the second side wall 6B. FIG. 12 shows only the clamp 11 pushed onto the body 2 in a front view; FIG. 13 shows only the clamp 11 in an oblique view and FIG. 14 shows the clamp 11 in a rearwards view. The clamp 11 compresses at least a section of the forward wall 4, which section comprises the joint 10, in a side-to-side direction 12 (see FIGS. 3 and 5). In this embodiment, the clamp 11 compresses the forward wall 4 by pressing together the first side wall 6A and the second side wall 6B. In this way, the body 2 is compressed at the joint 10 and the material of the body is held together at the joint 10. It is not necessary to weld the material at the joint 10, and thus there are no restrictions to the hardening or tempering of the body 2. Thus, the resistance and durability of the magazine 1 are increased. Alternatively, if welding is performed, the joint 10 is additionally strengthened. As an additional effect, the clamp 11 may act as a support or spacer for the magazine 1 in a magazine catch (not shown). Thus, it can reduce the wear of the magazine catch caused by the magazine 1 and its material, in particular where the magazine 1 is made from a harder material than the magazine catch (e.g. magazine made of a metal, magazine catch made of a polymer).

Optionally, the body 2 may be made of metal and/or the clamp 11 may be made of metal.

More particularly, the clamp 11 comprises a first clamp side wall 13A in contact with a section of the first side wall 6A of the body 2, opposite the first clamp side wall 13A a second clamp side wall 13B in contact with the second side wall 6B of the tubular body 2, and a clamp forward wall 14 connecting the first clamp side wall 13A and the second clamp side wall 13B and in contact with the forward wall 4 of the tubular body 2. Upon being slid onto the body 2, the first clamp side wall 13A and the second clamp side wall 13B are (elastically) stretched outwards by the body 2. I.e., the clamp 11 is pre-stressed/pre-tensioned with regard to the body 2.

The clamp 11 extends in the axial direction/top-to-bottom direction 15 of the body 2 over about 60% of the extension of the forward wall 4 in said direction 15.

The first side wall 6A and the second side wall 6B each comprise interacting latching elements in the form of recesses/apertures 28 (see FIG. 10) and the clamp 11 comprises corresponding interacting latching element in the form of inwardly projecting protrusions 29 (see FIG. 13 and FIG. 14). Each of the interacting latching elements in the form of apertures 28 on the first side wall 6A engages with, in particular receives, one of the interacting latching elements in the form of protrusions 29 on the first clamp side wall 13A; and each of the interacting latching elements in the form of apertures 28 on the second side wall 6B engages with, in particular receives, one of the interacting latching elements in the form of protrusions 29 on the second clamp side wall 13B.

The rearward wall 5 comprises an inwardly projecting protrusion 16 (see FIG. 1 and FIG. 5) extending in the axial direction 15 of the body 2. In this embodiment, the protrusion 16 is formed integrally as part of the rearward wall 5 of the body 2. I.e., the protrusion 16 is formed as the sheet material is shaped to form the body 2, e.g. by stamping.

The body 2 comprises two apertures 30 (see FIG. 11) each corresponding to two apertures 31 (see FIG. 13) of the clamp 11 for fixing the magazine 1 in a magazine catch.

Figure 15:
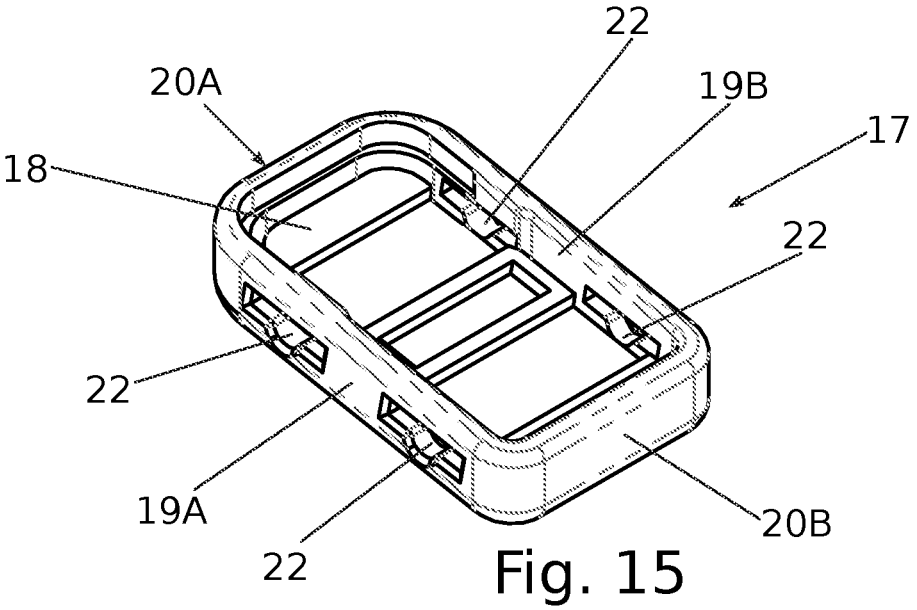
FIG. 15 schematically shows a removable closure member of the same embodiment of the firearm magazine as FIG. 1 in an oblique view.

The firearm magazine 1 further comprises a removable closure member 17 enclosing the open bottom 9 of the body 2. FIG. 15 shows only the removable closure member 17 in an oblique view. The removable closure member 17 is slid onto the body 2 in the bottom-to-top direction 15. The removable closure member 17 comprises a base element 18 and four side elements 19A, 19B, 20A, 20B extending from the base element 18 in the direction of the open top 7 of the tubular body 2 and substantially forming the lateral surface of a prism. In particular, the side elements 19A, 19B contact the first side wall 19A and the second side wall 19B of the tubular body 2, respectively. The side elements 20A, 20B contact the forward wall 4 and the rearward wall 5 of the tubular body 2, respectively. The base element 18 of the removable closure member 17 provides an end against which a spring 21 bears, which biases a follower.

Each of the two side elements 19A, 19B (which contact the first side wall 6A and the second side wall 6B, respectively) comprises two apertures 22. Each of the first side wall 6A and the second side wall 6B of the tubular body 2 comprises two corresponding apertures 23 (see FIG. 7 and FIG. 10). Respectively one aperture 22 of the side element 19A, of the first side wall 6A, of the second side wall 6B and of the side element 19B are aligned congruent to form a passage (pass-through), such that in total two passages are provided by the 8 overall apertures 22, 23 (of which only some are visible in the figures). The magazine 1 comprises two locking elements 24, which are shown on their own in FIG. 16. Each locking element 24 is slid into the respective apertures 22, 23 of one of the passages to secure the removable closure member 17 to the tubular body 2.

Figure 7:
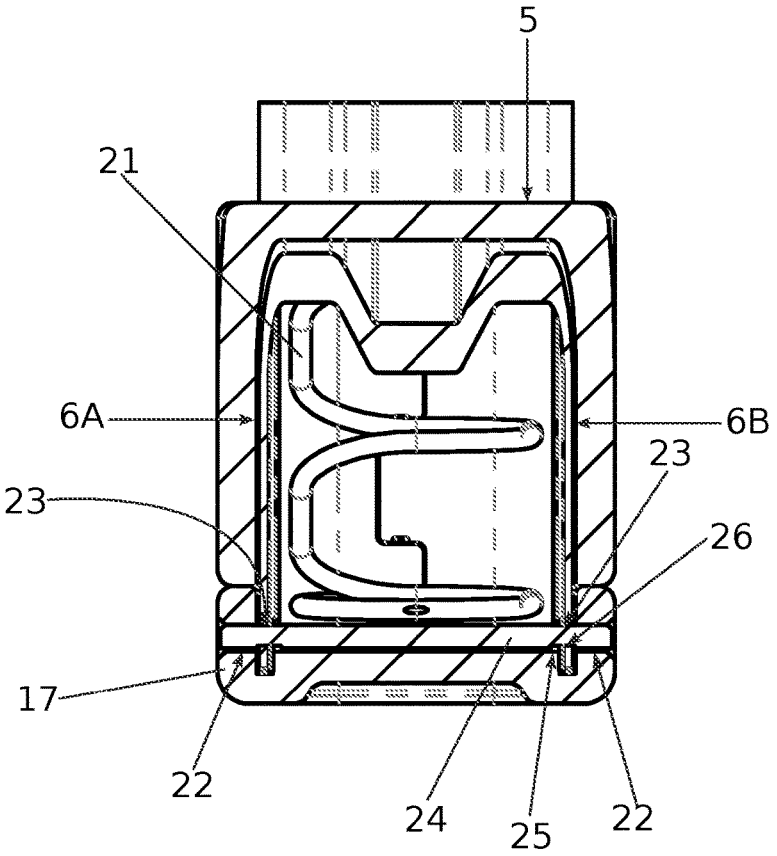
FIG. 7 schematically shows the same embodiment of the firearm magazine as FIG. 1 in a sectional view along the section C-C indicated in FIG. 2.
Figure 16:
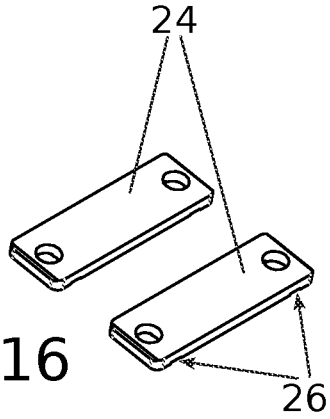
FIG. 16 schematically shows two locking elements of the same embodiment of the firearm magazine as FIG. 1 in an oblique view.

As can be seen in FIG. 7, the locking elements 24 on the one hand and the tubular body 2 on the other hand comprise interacting snapping elements 25 that prevent a sliding movement of the locking elements 24 in a secured state (i.e. when completely slid into the passage). For this purpose, the locking elements 24 each comprise two recesses 26 (see. FIG. 7 and FIG. 16), wherein into each of the two recesses 26 of each locking element 24 an edge of the aperture 23 of the first side wall 6A and of the second side wall 6B, respectively, is received. Thus, each locking element 24 snaps in with the first side wall 6A and the second side wall 6B at the respective recess 26. Each locking element 24 is plate-shaped and extends in a plane orthogonal to the top-to-bottom direction 15 of the tubular body 2. Each locking element 24 is slid into the respective apertures 22, 23 of the respective passage in the side-to-side direction 12 of the body 2.

Figure 17:
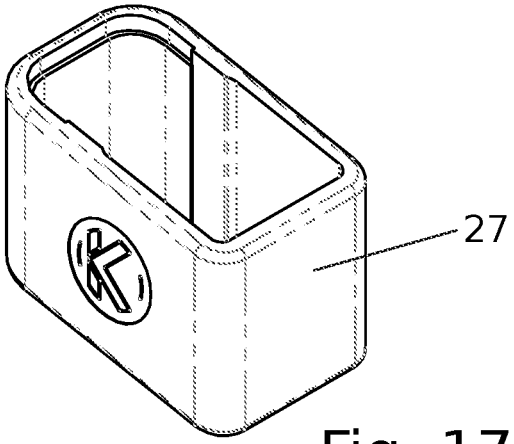
FIG. 17 schematically shows a magazine sleeve of the same embodiment of the firearm magazine as FIG. 1 in an oblique view.

The magazine 1 further comprises a magazine sleeve 27, which is slid onto the body 2 above the removable closure member 17. The magazine sleeve 27 is shown on its own in FIG. 17. The magazine sleeve 17 also supports the body 2 and the joint 10 close to the open bottom 9.

The invention claimed is:

1. A firearm magazine comprising:

a tubular body defining a hollow interior and having a forward wall, a rearward wall, a first side wall, a second opposite side wall, an open top and an open bottom opposite the open top, wherein the forward wall comprises a joint at which a material of the tubular body is joined together, wherein the joint runs along the forward wall between the open top and the open bottom;

a clamp, which is slid onto the tubular body and compresses at least a section of the forward wall in a side-to-side direction, wherein the section comprises the joint; and wherein the first side wall and the second side wall each comprise at least one interacting latching element and the clamp comprises corresponding interacting latching elements, wherein each of the at least one interacting latching element of the first side wall and of the second side wall engages with one of the interacting latching elements of the clamp.

2. The firearm magazine according to claim 1, wherein the clamp is in contact with a section of the first side wall and a section of the second side wall.

3. The firearm magazine according to claim 1, wherein the clamp comprises:

a first clamp side wall in contact with a section of the first side wall of the tubular body;

opposite the first clamp side wall a second clamp side wall in contact with the second side wall of the tubular body; and a clamp forward wall connecting the first clamp side wall and the second clamp side wall and in contact with the forward wall of the tubular body.

4. The firearm magazine according to claim 1, wherein the clamp is elastically stretched in a side-to-side direction by the tubular body.

5. The firearm magazine according to claim 1, wherein the clamp extends in an axial direction of the tubular body over at least half of the dimension of the forward wall.

6. The firearm magazine according to claim 1, wherein the at least one interacting latching element of the first side wall and of the second side wall comprise a recess and each of the interacting latching elements of the clamp comprises a protrusion received in the corresponding recess.

7. The firearm magazine according to claim 1, wherein the tubular body comprises a metal.

8. The firearm magazine according to claim 1, wherein the clamp comprises a metal.

9. The firearm magazine according to claim 1, wherein the tubular body is formed of at least one sheet material, wherein two edges of the at least one sheet material contacting each other form the joint.

10. The firearm magazine according to claim 1, wherein the rearward wall comprises an inwardly projecting protrusion extending in the axial direction of the tubular body.

11. The firearm magazine according to claim 10, wherein the inwardly projecting protrusion is integrally formed as a part of the rearward wall of the tubular body.

12. The firearm magazine according to claim 1, further comprising a removable closure member enclosing the open bottom of the body, comprising a base element and at least two side elements extending from the base element in the direction of the open top of the tubular body to contact opposite ones of the forward wall, the rearward wall, the first side wall and the second side wall of the tubular body, wherein each of the two side elements comprises an aperture and each of the opposite ones of the forward wall, the rearward wall, the first side wall and the second side wall of the tubular body each comprise a corresponding aperture, wherein a locking element is slid into the aperture of each of the two side elements and the corresponding aperture of each of the opposite ones of the forward wall, the rearward wall, the first side wall and the second side wall of the tubular body to secure the removable closure member to the tubular body.

13. The firearm magazine according to claim 12, wherein the locking element and the removable closure member or the tubular body comprise interacting snapping elements that prevent a sliding movement of the locking element in a secured state.

14. The firearm magazine according to claim 12, wherein the locking element comprises a recess into which an edge of one of the apertures is received.

15. The firearm magazine according to claim 14, wherein a part of one of the forward wall, the rearward wall, the first side wall and the second side wall of the tubular body is received in the recess of the locking element.

16. The firearm magazine according to claim 12, wherein the locking element is plate shaped and extends in a plane orthogonal to the top-to-bottom direction of the tubular body.

17. The firearm magazine according to claim 12, wherein the locking element is slid into the apertures in the side-to-side direction of the tubular body.

* * * * *